US006863247B2

(12) United States Patent
Horst

(10) Patent No.: US 6,863,247 B2
(45) Date of Patent: Mar. 8, 2005

(54) METHOD AND APPARATUS FOR TRANSMITTING SIGNALS TO A LOCOMOTIVE CONTROL DEVICE

(75) Inventor: Folkert Horst, Pierrefonds (CA)

(73) Assignee: Beltpack Corporation, Montreal (CA)

( * ) Notice: Subject to any disclaimer, the term of this patent is extended or adjusted under 35 U.S.C. 154(b) by 0 days.

(21) Appl. No.: 10/448,520

(22) Filed: May 30, 2003

(65) Prior Publication Data

US 2004/0238695 A1 Dec. 2, 2004

(51) Int. Cl.[7] ..... B61L 3/00

(52) U.S. Cl. ..... 246/187 A

(58) Field of Search ..... 246/167 R, 186, 246/187 R, 187 A, 187 B

(56) References Cited

U.S. PATENT DOCUMENTS

| | | | | |
|---|---|---|---|---|
| 3,639,755 A | | 2/1972 | Wrege | |
| 4,245,347 A | | 1/1981 | Hutton et al. | |
| 4,264,954 A | | 4/1981 | Briggs et al. | |
| 4,529,980 A | | 7/1985 | Liotine et al. | |
| 4,553,723 A | | 11/1985 | Nichols et al. | |
| 4,582,280 A | | 4/1986 | Nichols et al. | |
| 4,687,258 A | * | 8/1987 | Astley | 303/3 |
| 4,912,463 A | | 3/1990 | Li | |
| 5,039,038 A | | 8/1991 | Nichols et al. | |
| 5,122,948 A | | 6/1992 | Zapolin | |
| 5,495,520 A | | 2/1996 | Kojima | |
| 5,511,749 A | | 4/1996 | Horst et al. | |
| 5,533,695 A | | 7/1996 | Heggestad et al. | |
| 5,570,284 A | | 10/1996 | Roselli et al. | |
| 5,681,015 A | | 10/1997 | Kull | |
| 5,685,507 A | | 11/1997 | Horst et al. | |

(List continued on next page.)

FOREIGN PATENT DOCUMENTS

| | | |
|---|---|---|
| DE | 2450074 | 10/1974 |
| DE | 3618464 | 12/1987 |
| DE | 4242231 | 6/1994 |
| EP | 0326630 | 6/1992 |
| EP | 0704590 | 4/1996 |
| EP | 0928732 | 7/1999 |
| EP | 1344703 | 9/2003 |
| EP | 1344704 | 9/2003 |
| FR | 2493567 | 10/1980 |
| WO | WO 9636953 | 11/1996 |
| WO | WO 0058142 | 10/2000 |

OTHER PUBLICATIONS

"RCL Standards Draft White Paper", Jul. 22, 2002.
"Review of Technical and Trade Literature, 1980 Forward", Laurie Mitchell, May 20, 2003, Information Works Inc.

(List continued on next page.)

*Primary Examiner*—S. Joseph Morano
*Assistant Examiner*—Robert J. McCarry, Jr.
(74) *Attorney, Agent, or Firm*—Ladas & Parry LLP

(57) ABSTRACT

The present invention provides a portable remote control device adapted for transmitting command signals to a locomotive control device located onboard a locomotive. The command signals are indicative of a command to be executed by the locomotive. The portable remote control device is adapted for transmitting the command signals over either a remote communication link or a proximity communication link at least in part on the basis of a link selection signal received by the remote control device, wherein the link selection signal is indicative of the proximity of the portable remote control device to the locomotive. The remote communication link and the proximity communication link are distinguishable based on their range of communication. More specifically, the remote communication link permits the remote control device and the locomotive control device to communicate over a greater distance than the proximity communication link.

22 Claims, 17 Drawing Sheets

U.S. PATENT DOCUMENTS 5,729,210 A 3/1998 Kiriyama
5,746,261 A 5/1998 Bowling
5,815,823 A 9/1998 Engle
5,884,146 A 3/1999 Simmons
6,218,961 B1 4/2001 Gross et al.
6,314,345 B1 11/2001 Coombes
6,400,281 B1 6/2002 Darby, Jr. et al.
6,449,536 B1 * 9/2002 Brousseau et al. ..... 701/19
6,456,674 B1 9/2002 Horst et al.
6,466,847 B1 10/2002 Horst
6,470,245 B1 10/2002 Proulx
6,658,331 B2 * 12/2003 Horst et al. ..... 701/19
6,691,005 B2 2/2004 Proulx
6,693,584 B2 2/2004 Horst et al.
6,697,716 B2 2/2004 Horst

OTHER PUBLICATIONS

CANAC Beltpack Product Development, presentation slides; Feb. 17, 1998.

* cited by examiner

METHOD AND APPARATUS FOR TRANSMITTING SIGNALS TO A LOCOMOTIVE CONTROL DEVICE

FIELD OF THE INVENTION

The present invention relates generally to a method and apparatus for transmitting signals to a locomotive control device. More particularly, the present invention relates to a method and apparatus for transmitting signals to a locomotive control device over both a remote communication link and a proximity communication link.

BACKGROUND OF THE INVENTION

Remote control systems for controlling locomotives are known in the art. Broadly stated, a remote control system for a locomotive has two main components, namely a remote control device and a locomotive control device. Typically, the locomotive control device is mounted on board the locomotive and is adapted for receiving command signals sent by the remote control device over a wireless communication link. The remote control device is typically a portable unit that is carried by a human operator located at a certain distance from the locomotive. When the operator would like to cause a movement of the locomotive in a certain direction, or at a certain speed, for example, he or she manipulates the controls on the remote control device in order to specify the desired parameters (i.e. forward, backwards, speed, etc.). The parameters are encoded into a command signal, which is sent by the remote control device to the locomotive control device. The locomotive control device processes the command signal and issues local control signals to a control interface for causing the desired commands to be implemented by the locomotive.

When a train operator is located within the operator cabin of the locomotive, the train can be controlled via the locomotive console. As such, the locomotive remote control system provides the ability to control the train from both a remote location via the remote control device, and from a location within the locomotive via the locomotive console. However, a deficiency with existing remote control systems is that the train operator must learn how to control the train using the different interfaces of the remote control device and the locomotive console. This can often lead to inadvertent mistakes, when controlling the locomotive.

In the context of the above, there is a need in the industry to provide a method and device that alleviates at least in part the problems associated with the existing remote control systems.

SUMMARY OF THE INVENTION

In accordance with a first broad aspect, the invention provides a portable remote control device adapted for transmitting command signals to a locomotive control device located onboard a locomotive, wherein the command signals are indicative of a command to be executed by the locomotive. The portable remote control device is adapted for transmitting the command signals over either a remote communication link or a proximity communication link.

In accordance with a specific example of implementation, the communication link for transmitting the command signals is selected at least in part on the basis of a link selection signal received by the remote control device. In a non-limiting example, the link selection signal is indicative of the proximity of the portable remote control device to the locomotive.

In accordance with a specific embodiment, the remote communication link is a radio frequency (RF) communication link. The proximity communication link may be any suitable communication link such as, but not limited to, a short range radio frequency (RF) communication link, an infra-red communication link, an optical link and a wire-line communication link.

In accordance with another broad aspect, the invention provides a portable remote control device for a locomotive remote control system. The remote control device includes a first input for receiving an input command signal from a train operator, and a second input for receiving a signal indicating proximity of the portable remote control device to a locomotive. The remote control device further includes a processing unit in communication with the first input and the second input. The processing unit is adapted for generating command data indicative of a command to be executed by a locomotive in response to the input command signal, and for selecting either a remote communication link or a proximity communication link for the transmission of the command data. The selection between the communication links is effected at least in part on the basis of the signal indicating proximity of the portable remote control device to a locomotive. Furthermore, the remote control device includes a transmission interface that is operative for transmitting to a locomotive control device the data indicative of a command to be executed by the locomotive over the selected transmission link.

In accordance with yet another broad aspect, the invention provides a locomotive control device adapted for being located onboard a locomotive. The locomotive control device comprises an input for receiving a selection signal for selecting either one of a remote communication link and a proximity communication link. The locomotive control device further comprises a communication entity that is responsive to the selection signal for selecting one of the remote communication link and the proximity communication link on the basis of the selection signal, and for receiving command signals over the selected communication link from a remote control device. The command signals are indicative of commands to be executed by the locomotive. The locomotive control unit is then operative for issuing a local control signals to a locomotive control interface for causing the locomotive to execute commands conveyed by the command signals.

In accordance with another broad aspect, the invention provides a method for establishing a communication link between a portable remote control device and a locomotive control located onboard a locomotive. The method includes receiving at the portable remote control device an input signal from a train operator, wherein the input signal is indicative of a command to be executed by the locomotive. The method further includes processing the input signal for generating command data indicative of the command to be executed by the locomotive, and receiving at the portable remote control device a selection signal. The selection signal is indicative of the proximity of the portable remote control device to a locomotive. Finally the method includes selecting between a remote communication link and a proximity communication link at least in part on the basis of the received selection signal, and transmitting over the selected communication link to the locomotive control device, the data indicative of the command to be executed by the locomotive.

In yet another broad aspect, the present invention provides a system comprising the remote control device and the locomotive control device described above.

These and other aspects and features of the present invention will now become apparent to those of ordinary skill in the art upon review of the following description of specific embodiments of the invention in conjunction with the accompanying drawings.

Other aspects and features of the present invention will become apparent to those ordinarily skilled in the art upon review of the following description of specific embodiments of the invention in conjunction with the accompanying figures.

DETAILED DESCRIPTION

Figure 1:
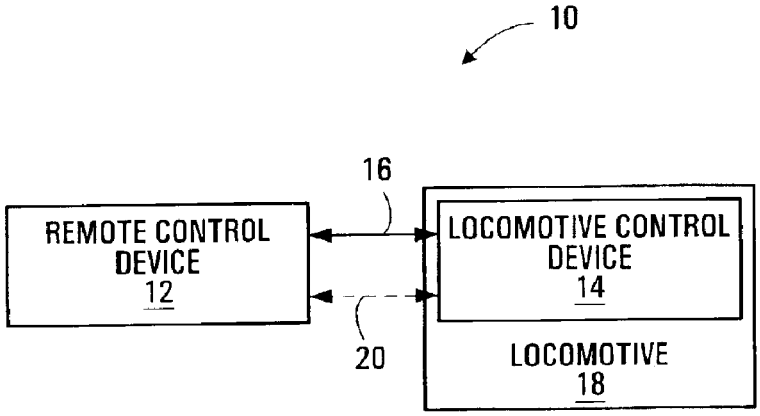
FIG. 1 shows a high level block diagram of a remote control system for a locomotive, in accordance with a specific example of implementation of the present invention.

Shown in FIG. 1 is a high-level block diagram of a remote control system 10 in accordance with a specific example of implementation of the present invention. The remote control system 10 includes two main components; namely a portable remote control device 12 and a locomotive control device 14. In use, the locomotive control device 14 is mounted on board a locomotive 18.

In use, the portable remote control device 12 can be positioned remotely from the locomotive 18, or in close proximity to the locomotive 18. In the case where the remote control device 12 is positioned remotely from the locomotive 18, the remote control device 12 is adapted to communicate with the locomotive control device 14 over a remote communication link 16. However, in the case when the portable remote control device 12 is positioned within close proximity to the locomotive 18, it is adapted to communicate with the locomotive control device 14 over a proximity communication link 20. The remote communication link 16 and the proximity communication link 20 are distinguishable based on their range of communication. More specifically, the remote communication link 16 permits the remote control device 12 and the locomotive control device 14 to communicate over a greater distance than the proximity communication link 20. It is within the scope of the present invention for the remote communication link 16 to enable the remote control device 12 to communicate with the locomotive control device 14 when the remote control device 12 is positioned both at a distance, and in proximity, to the locomotive 18. However, the proximity communication link 20 is restricted to enabling the remote control device 12 to communicate with the locomotive control device 14 when the remote control device 12 is positioned in close proximity to the locomotive 18. For example, the proximity communication link 20 can restrict the remote control device 12 to communicating with the locomotive control device 14 when the remote control device 12 is located within the operator cabin of the locomotive 18.

In a specific example of implementation, the remote communication link 16 is an RF communication link. The remote communication link 16 can be established using a plurality of possible RF frequencies that permit long range communication. For further information regarding the transmission of commands over an RF communication link, the reader is invited to refer to U.S. Pat. No. 6,456,674 issued on Sep. 24, 2002 and Canadian application serial no. 2,266,998 filed on Mar. 25, 1999. The contents of these documents are incorporated herein by reference.

In a further specific example of implementation, the proximity communication link 20 may be embodied as any suitable communication link, such as, for example, an inductive communication link, an optical communication link, an infrared communication link, a short-range RF communication link, or an electrical wire-line communication link. In a specific example of implementation, when the remote control device 12 and the locomotive control device 14 communicate over the proximity communication link 20, the remote control system 10 is not being used, and consequently is free for alternative use.

By enabling the remote control device 12 and the locomotive control device 14 to communicate over both a remote communication link 16 and a proximity communication link 20, the remote control system 10 provides the benefit of enabling a train operator to control the locomotive from both a remote location, such as from the ground in a switchyard, and a proximity location, such as from the operator cabin of a locomotive, using the same remote control device 12. As such, a train operator is not required to learn how to control or transfer between two different control interfaces. This provides an increase in the safety of the remote control system 10 since it reduces the likelihood of human error. The remote control system 10 of the present invention further provides increased productivity, since an operator does not need any set-up time to switch from one control device to another.

Figure 2:
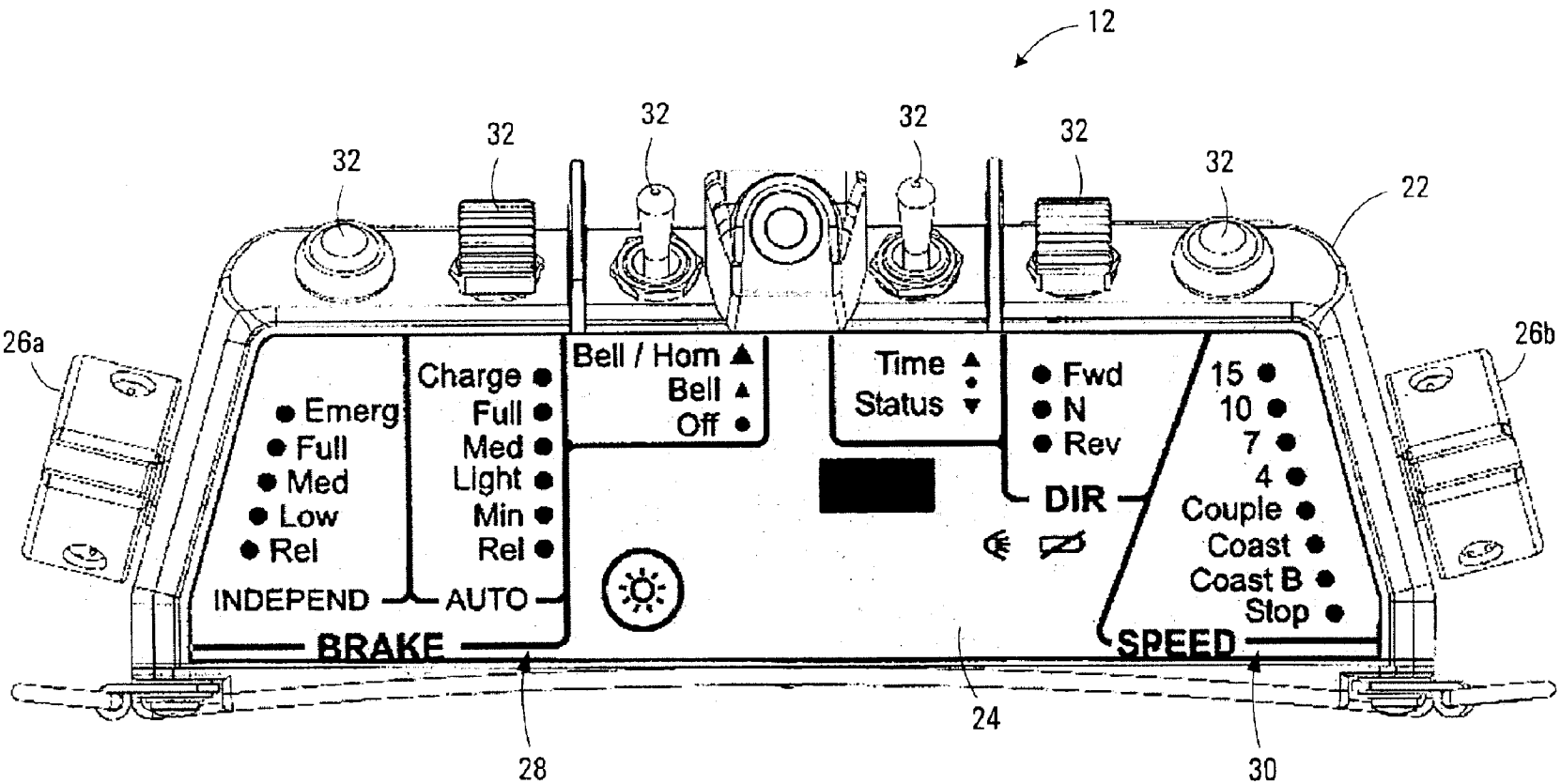
FIG. 2 shows a specific example of a physical implementation of a remote control device, in accordance with a specific non-limiting example of implementation of the present invention.

In a specific example of implementation, the portable remote control device 12 is adapted for being carried by a human operator located at a distance from the locomotive. Shown in FIG. 2 is a specific example of a physical implementation of the remote control device 12 of the present invention. The remote control device 12 is in the form of a portable unit that includes a housing 22 for enclosing electronic circuitry, a battery for supplying electrical power (not shown) and a user interface 24 for enabling the user to enter command signals indicative of commands to be implemented by the locomotive 18. In the specific embodiment shown, the user interface 24 includes two dials 26*a* and 26*b* located on either side of the housing 22, that are able to be manipulated by a user. Specifically, by manipulating dial 26*a* located on the left, the user is able to enter brake commands. The brake command information is displayed on the display portion 28 shown on the front of the housing 22. By manipulating dial 26*b* located on the right, the user is able to enter speed command signals. The speed command information is displayed to the user via display portion 30 shown on the front of the housing 22. Other commands, such as on/off, bell/horn activation and forward/reverse, can be entered via control knobs and buttons 32 located on the upper portion of the housing 22. Although a specific embodiment of the remote control device 12 has been described herein, it should be understood that the physical implementation of the remote control device 12 can vary greatly without departing from the spirit of the invention. For example, the control interface 24 can include a keyboard, button, levers, toggles, a touch sensitive screen, a voice recognition unit or any other suitable input device known in the art for allowing an operator to convey command information.

Figure 3A:
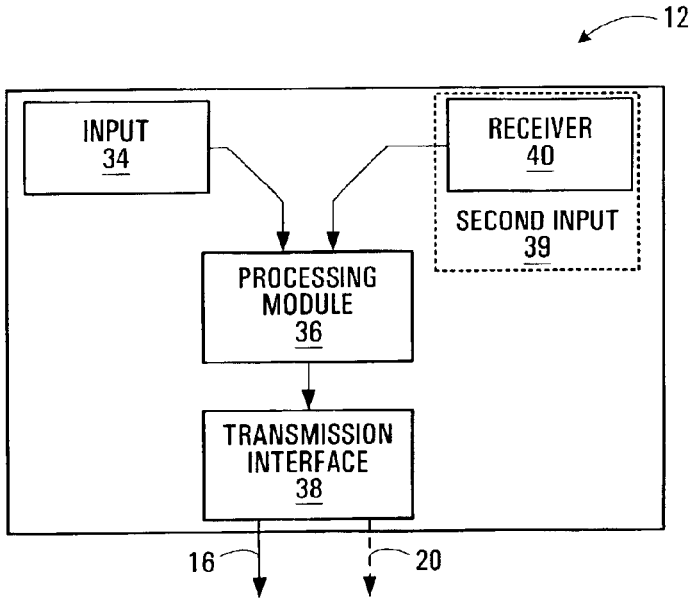
FIG. 3*a* shows a functional block diagram of a remote control device, in accordance with a first specific example of implementation of the present invention.
Figure 3B:
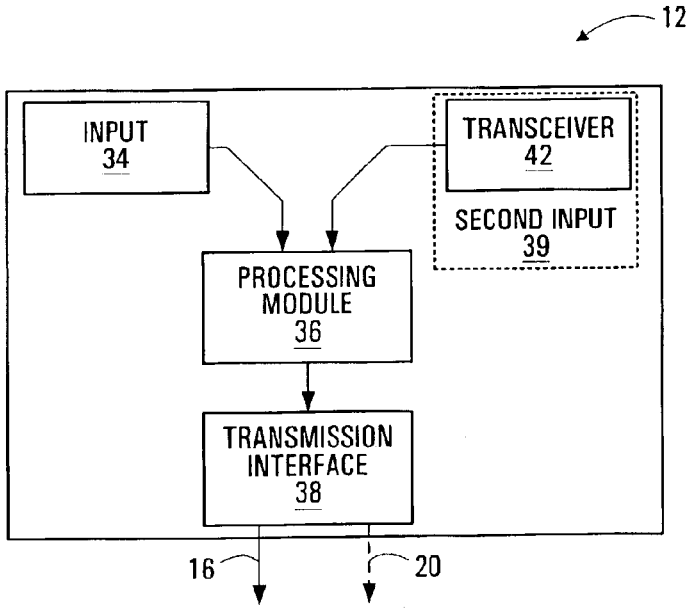
FIG. 3*b* shows a functional block diagram of a remote control device, in accordance with a second specific example of implementation of the present invention.

The functionality of the remote control device 12 will now be described in more detail with reference to FIGS. 3*a* and 3*b*. In both the embodiments shown in FIGS. 3*a* and 3*b*, the remote control device 12 includes a first input 34, a second input 39, a processing module 36, and a transmission interface 38. In the embodiment shown in FIG. 3*a*, the second input 39 includes a receiver 40, and in the embodiment shown in FIG. 3*b* the second input 39 includes a transceiver 42.

The input 34 is adapted for receiving an input command signal from a train operator. The input command signal can be indicative of a speed command, a forward/backward command, a brake command, a horn command or any other type of command for operating a function of the locomotive. In a non-limiting example of implementation, the input command signal received at input 34 is entered by the train operator via the user interface 24 (shown in FIG. 2).

The processing module 36 is in communication with input 34 for receiving the input command signal, and for generating, in response to that command signal, command data indicative of a command to be executed by a locomotive. The transmission interface 38 is operative to transmit that command data to the locomotive control device 14, over a selected one of the remote communication link 16 or the proximity communication link 20.

As will be described in more detail further on, the second input 39 is operative to receive a link selection signal, on the basis of which, the processing module 36 is operative to select either the remote communication link 16 or the proximity communication link 20, for transmitting the command data.

Figure 4A:
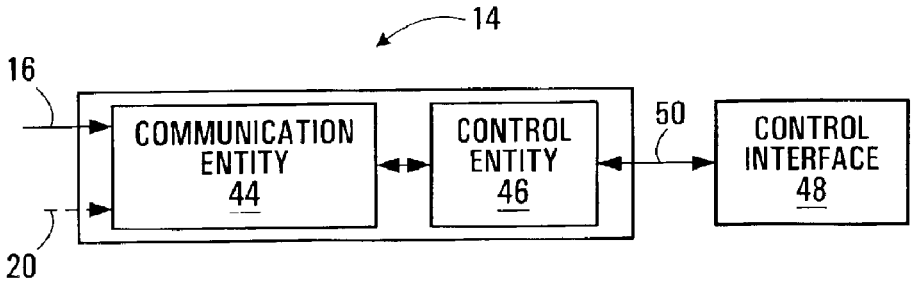
FIG. 4*a* shows a functional block diagram of a locomotive control device, in accordance with a first specific example of implementation of the present invention.
Figure 4B:
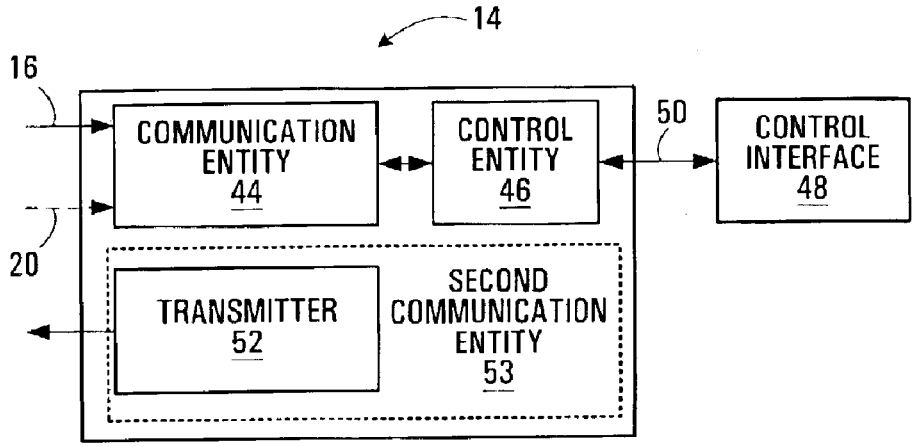
FIG. 4*b* shows a functional block diagram of a locomotive control device, in accordance with a second specific example of implementation of the present invention.
Figure 4C:
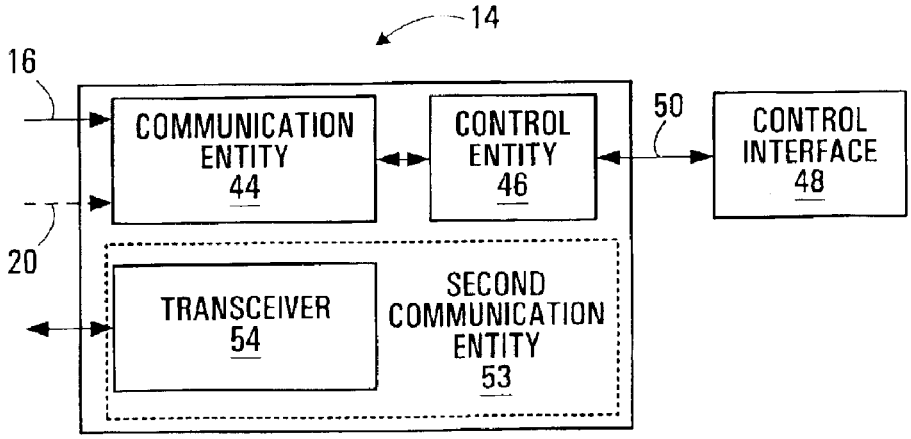
FIG. 4*c* shows a functional block diagram of a locomotive control device, in accordance with a third specific example of implementation of the present invention.

The locomotive control device 14 will now be described with reference to FIGS. 4*a*, 4*b* and 4*c*. FIGS. 4*a*, 4*b* and 4*c* show three specific embodiments of a locomotive control device 14, in accordance with the present invention. In all three embodiments, the locomotive control device 14 includes a communication entity 44 and a control entity 46. In addition to these components, in the embodiments shown in FIGS. 4*b* and 4*c*, the locomotive control device 14 includes an output 53. More specifically, in the embodiment shown in FIG. 4*b* output 53 includes a transmitter 52, and in the embodiment shown in FIG. 4*c* output 53 includes a transceiver 54.

As shown in all of FIGS. 4*a*, 4*b* and 4*c*, the control entity 46 is in communication with the locomotive's control interface 48 over communication link 50. For the purposes of the present application, the term "control interface 48" refers globally to the collection of various actuators located on the train for executing various control signals issued by the control entity 46 of the locomotive control device 14. Examples of such actuators include the actuators that control the throttle and the brakes, among others.

In use, the locomotive control device 14 is operative to receive the command data transmitted from the remote control device 12 over the selected one of the remote communication link 16 or the proximity communication link 20. Once the communication entity 44 has received the command data over the selected communication link, the command data is passed to the control entity 46, which processes the command data in order to issue local command signals to the control interface 48 for causing the locomotive to execute the commands conveyed by the command data.

The method of transmitting the command data from the remote control device 12 to the locomotive control device 14 over either the remote communication link 16 or the proximity communication link 20 will now be described with reference to the flow chart shown in FIG. 5. At step 60, an input command signal is received at remote control device 12 (shown in FIGS. 3*a* and 3*b*). As described above, the input command signal is received via input 34. At step 62, the processing module 36 processes the input command signal in order to generate command data for transmission to the locomotive control device 14. At step 68, the transmission interface 38 transmits the command data over a selected one of either the remote communication link 16 or the proximity communication link 20. The communication link is selected at least in part on the basis of a link selection signal that is received at the second input 39 of the remote control device 12.

More specifically, at step 64, the remote control device 12 receives a link selection signal at input 39. At step 66 the processing module 36 selects either the proximity communication link 20 or the remote communication link 16 at least in part on the basis of the link selection signal. For example, in the case where the remote control device 12 receives a signal indicating that the remote control device 12 is in proximity to a locomotive, the processing module 36 will select the proximity communication link 20, and in the case where the remote control device 12 receives a signal indicating that the remote control device 12 is not in proximity to a locomotive, the processing module 36 will select the remote communication link 16. In an alternative example of implementation, in the absence of a selection signal indicating that the remote control device 12 is in proximity to a locomotive, the processing module 36 will select the remote communication link 16. Therefore, for the purposes of the present invention, the term "on the basis of a link selection signal", means either on the presence of a link selection signal, on the contents of a link selection signal, or based on the absence of a link selection signal.

Figure 5:
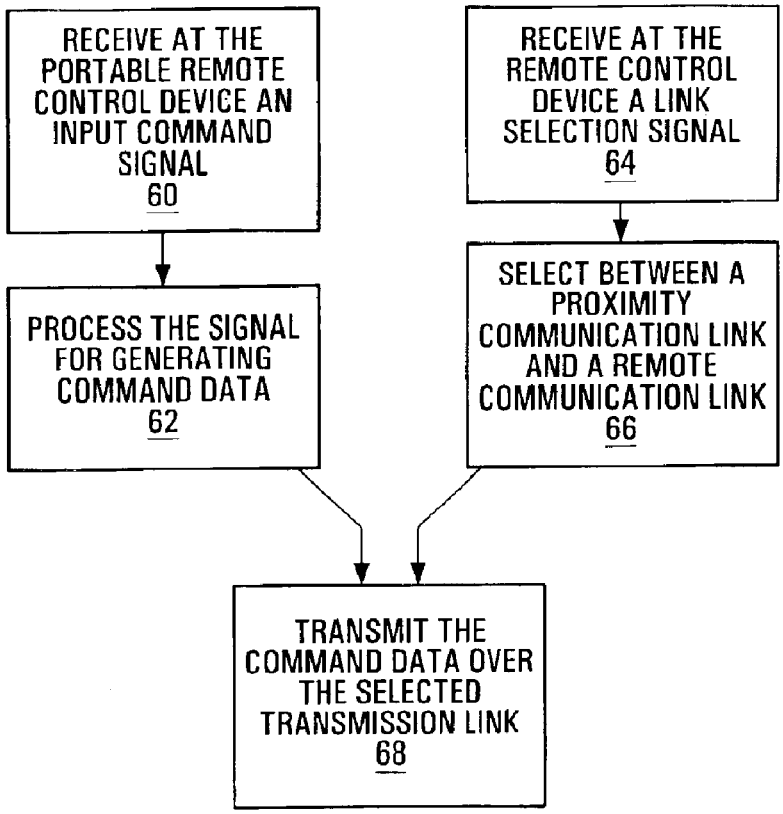
FIG. 5 shows a flow diagram of a method of establishing a communication link between a remote control device and a locomotive control device, in accordance with a specific example of implementation of the present invention.

FIG. 5 shows steps 64 and 66 as being performed independently of steps 60 and 62. In other words, selecting a communication link is not necessarily dependent on having received an input command signal, nor is receiving an input command signal dependent on selecting a communication link. It is within the scope of the invention for the remote control device 12 to transmit a plurality of signals containing command data over a selected communication link on the basis of one link selection signal. In addition, in the absence of a link selection signal, the system 10 may transmit multiple signals over the remote communication link 16, until a link selection signal is received.

Figure 6:
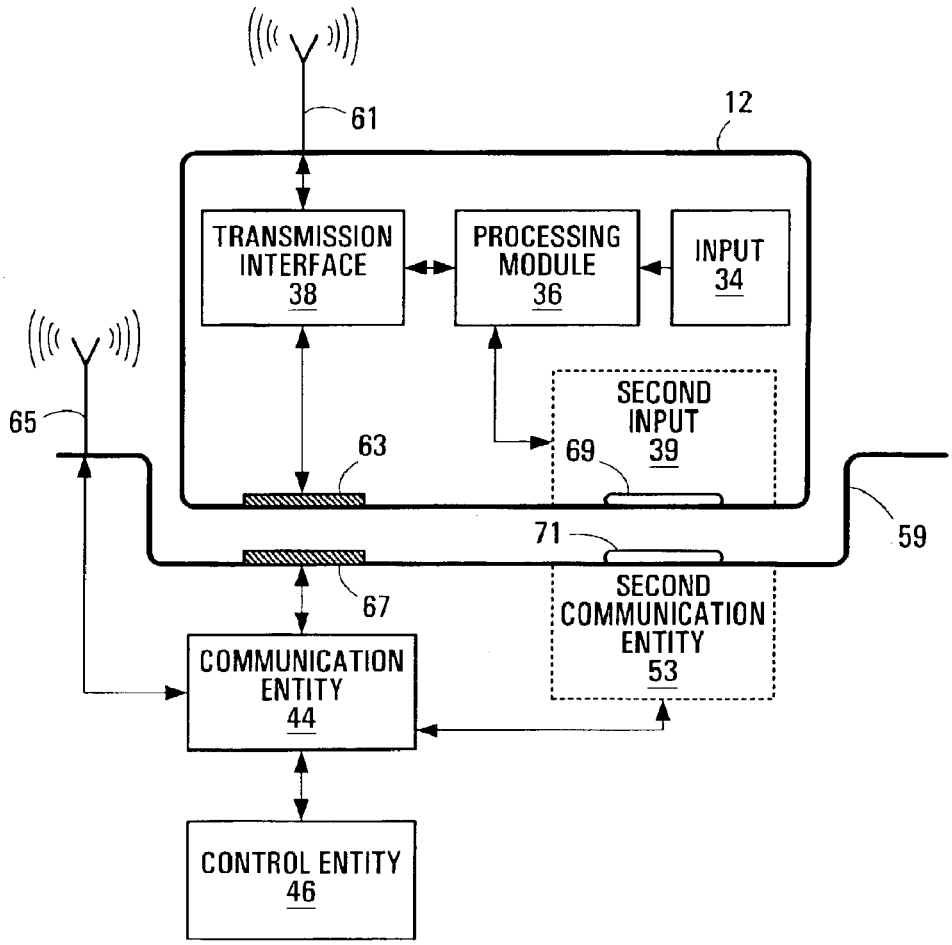
FIG. 6 shows a specific example of a docking port for receiving the remote control device, in accordance with a specific example of implementation of the present invention.

Shown in FIG. 6 is a representation of a remote control device 12 in proximity to a locomotive control device 14. In the specific representation shown, the remote control device 12 is positioned within a docking port 59 the locomotive control device 14. The docking port 59 is preferably any type of positioning device, such as straps or a recess within a panel or console adapted for receiving therein the remote control device 12. Preferably, the docking port 59 is able to position the remote control device 12 and the locomotive control device 14 such that the two can communicate over proximity communication link 20. However, it should be understood that a docking port 59 is not required in order to establish a proximity communication link 20 between the remote control device 12 and the locomotive control device 14. In an alternative embodiment, a user can simply carry the remote control device 12 while in the operator cab of the locomotive. Therefore, an advantage of the present invention is that the remote control device 12 can be moved around the operator cab of the locomotive such that the operator can control the locomotive from a "best" vantage point.

It should also be understood that the locomotive can be equipped with more than one docking port 59, such that the remote control device 12 can be docked at a plurality of different locations. In addition, it is within the scope of the invention for a single remote control device 12 to be able to be docked at docking ports 59 located in different locomotives.

In FIG. 6, the remote control device 12 includes a remote communication interface 61 for transmitting, and optionally receiving, signals over the remote communication link 16. Remote control device 12 also includes a proximity communication interface 63 for transmitting, and optionally receiving, signals over the proximity communication link 20. In the specific embodiment shown, the remote communication interface 61 is an RF antenna. The proximity communication interface 63 has been represented as a rectangle for the purposes of simplicity only, and may include any one of an optical communication interface, an electrical wire-line communication interface, a short range RF communication interface and an inductive communication interface.

In a specific, non-limiting example of implementation, the remote control device 12 includes a proximity detector 69 for detecting when the remote control device 12 is in proximity to the locomotive 18. The proximity detector 69 is in communication with second input 39 for providing the latter with a signal indicative of proximity between remote control device 12 and locomotive control device 14. The proximity detector 69 can be a separate component from the proximity communication interface 63, as show in FIG. 6, or the functionality of the proximity detector 69 can be included within the proximity communication interface 63. It should also be understood that the proximity detector 69 is an optional component that is only required in certain embodiments of the present invention.

The locomotive control device 14 includes a remote communication interface 65 for receiving, and optionally transmitting, signals over the remote communication link 16, and a proximity communication interface 67 for receiving, and optionally transmitting, signals over the proximity communication link 20. In the specific embodiment shown, the remote communication interface 65 is an RF antenna. The proximity communication interface 67 has been represented as a rectangle for the purposes of simplicity only, and may include any one of an optical communication interface, an electrical wire-line communication interface, a short range RF communication interface and an inductive communication interface.

In a specific, non-limiting example of implementation, the locomotive control device 14 includes a proximity detector 71 for detecting when the remote control device 12 is in proximity to the locomotive 18. The proximity detector 71 can be a separate component from the proximity communication interface 67, as show in FIG. 6, or the functionality of the proximity detector 71 can be included within the proximity communication interface 67. It should also be understood that the proximity detector 71 is an optional component that is only required in certain embodiments of the present invention.

As such, when the remote control device 12 and the locomotive control device 14 communicate over the remote communication link 16, it is the remote communication interface 61, and the remote communication interface 65, that exchange signals. Similarly, when the remote control device 12 and the locomotive control device 14 communicate over the proximity communication link 20, it is the proximity communication interface 63, and the proximity communication interface 67, that exchange signals.

Although FIG. 6 shows the remote communication interface 61 and the proximity communication interface 63 of the remote control device 12 as being separate interfaces, in an alternative embodiment of the present invention, these two interfaces can be the same physical interface. Similarly, the remote communication interface 65 and the proximity communication interface 67 of the locomotive control device 14 can be the same physical interface.

There are many different manners in which the remote control device 12 and the locomotive control device 14 may establish communication therebetween over a selected one of the remote communication link 16 and the proximity communication link 20. A few specific, non-limiting embodiments will be described herein below.

First Embodiment—Selection Signal Received Via an Operator Activated Input

Figure 7:
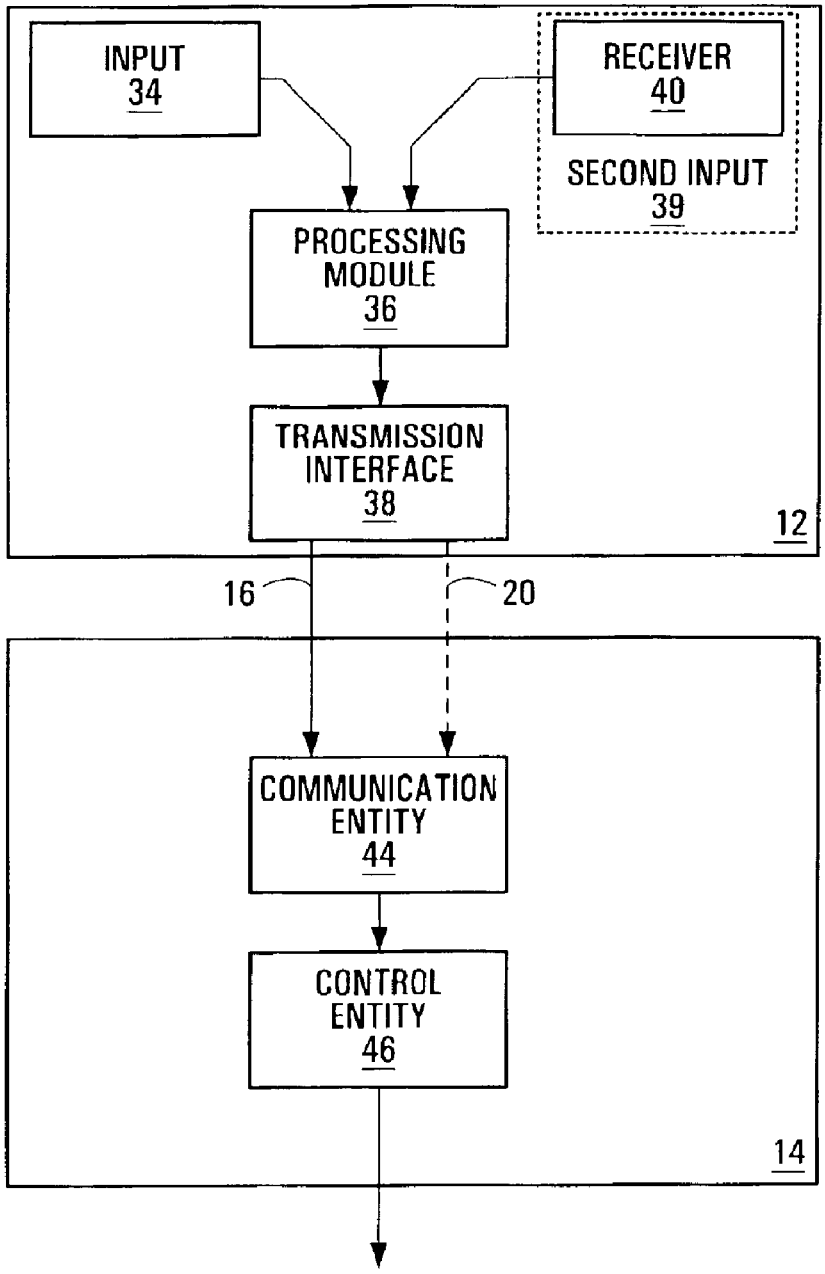
FIG. 7 shows a functional block diagram of a remote control device and a locomotive control device in communication with each other, in accordance with a specific example of implementation of the present invention.

In a first specific embodiment of the invention, the remote control device 12 is operative to receive a link selection signal from an operator activated input, that indicates that the remote control device 12 is in proximity to a locomotive 18. For ease of reference, this first specific embodiment will be described with reference to a specific embodiment of the remote control device 12 and the locomotive control device 14 shown in FIG. 7.

The operator activated input can be entered by the user via a switch, button, touch sensitive screen, voice recognition unit, or any other operator activated input device known in the art. Preferably, the operator activated input device is contained on the user interface 24 of the remote control device 12. Once the link selection signal has been entered via the user interface 24, it is received at second input 39 of the remote control device 12.

In the case where the user activates a switch to enter the selection signal, the switch is operable to be moved between a proximity position and a remote position. As such, when the remote control device 12 is in proximity to the locomotive 18, the user moves the switch to the proximity position, which causes the second input 39 to receive a selection signal indicating to the processing module 36 that the proximity communication link 20 should be selected. Then, when the remote control device 12 is to be taken away from the locomotive such that it will no longer be in proximity thereto, the user moves the switch to the remote position, which causes the second input 39 to receive a selection signal indicating to the processing module 36 that the remote communication link 16 should be selected.

Once the second input 39 has received the selection signal via an operator activated input, there are many scenarios in which the remote control device 12 and the locomotive control device 14 can establish communication over the selected communication link. Three non-limiting examples of scenarios will be described below with reference to FIGS. 8*a*, 8*b* and 8*c*.

First Scenario

Figure 8A:
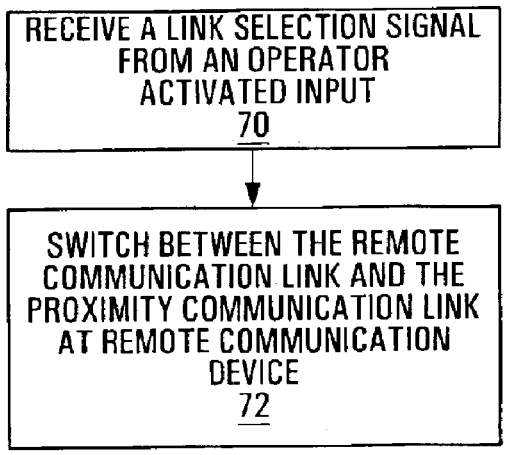
FIGS. 8*a*–8*c* show flow diagrams of a process for selecting a communication link wherein the selection signal is received via an operator activated input, in accordance with three specific examples of implementation of the present invention.

In a first scenario, which is described in the flow chart shown in FIG. 8*a*, the first step 70 involves receiving at the second input 39 of the remote control device 12 a link selection signal from an operator activated input. The second step 72 involves the processing module 36 selecting either the remote communication link 16 or the proximity communication link 20, in response to the selection signal. Once selected, the transmission interface 38 of the remote control device 12 is operative to transmit the command data to the locomotive control device 14 over the selected one of the remote communication link 16 or the proximity communication link 20.

Preferably, in this first scenario described in FIG. 8*a*, the locomotive control device 14 is adapted to receive signals sent over both the remote communication link 16 and the proximity communication link 20. As such, the locomotive control device 14 is programmed such that when it receives signals over the proximity communication link 20, it disregards signals received over the remote communication link 16. Alternatively, instead of having the locomotive control device 14 disregard signals received over the remote communication link 16 when it receives signals over the proximity communication link 20, the processing module 36 of the remote control device 12 embeds link selection data with the transmitted command data, the link selection data indicating which communication link the locomotive control device 14 should be listening to.

Second Scenario

Figure 8B:
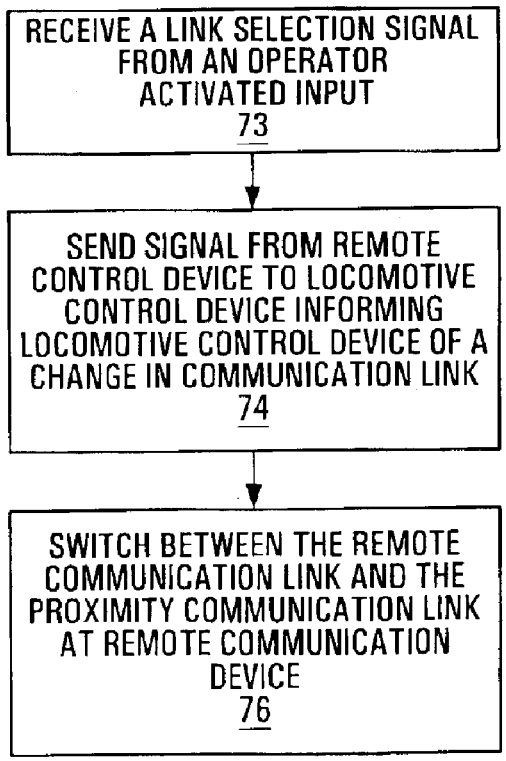

In a second scenario, which is described in the flow chart shown in FIG. 8*b*, the first step 73 involves receiving at second input 39, a link selection signal from an operator activated input. In response to the link selection signal, at step 74, the processing module 36 transmits a signal to the locomotive control device 14 over the communication link that the remote control device 12 was using when it received the selection signal, indicating to the locomotive control device 14 that it is about to start transmitting the command data over the other communication link. At step 76, once the signal indicative of the planned change in communication links has been sent to the locomotive control device 14, the processing module 36 selects the new communication link for transmission.

This second scenario provides the advantage that the locomotive control device 14 is not required to receive signals over both the remote communication link 16 and the proximity communication link 20. Instead the locomotive control device 14 can stop monitoring signals over the proximity communication link 20 when the remote control device 12 sends a signal indicating that it is about to start using the remote communication link 16. Likewise, the locomotive control device 14 can stop monitoring signals over the remote communication link 16 when the remote control device 12 sends a signal indicating that it is about to start using the proximity communication link 20.

During the normal operation of the scenario described with respect to FIG. 8*b*, the processing module 36 sends the signal indicating the change in communication links over the communication link that it was in the process of using when it received the selection signal. For example, in the case where the remote control device 12 and the locomotive control device 14 were communicating over the remote communication link 16 when the remote control device 12 received the selection signal, the remote control device 12 transmits a signal over the remote communication link 16 indicating that it is about to start sending signals over the proximity communication link 20. As such, upon receipt of this signal, the locomotive control device 14 starts monitoring signals over the proximity communication link 20.

In order to switch from the proximity communication link 20 to the remote communication link 16, upon receipt of a selection signal, the remote control device 12 sends a signal to the locomotive control device 14 over the proximity communication link 20, indicating that it is about to start sending signals over the remote communication link 16. The locomotive control device 14 then starts monitoring signals received over the remote communication link 16. Therefore, once the locomotive control device 14 has received a signal from the remote control device 12 indicating a switch in communication links, the locomotive control device 14 ceases to monitor signals received over the old communication link.

During the course of normal operation of this second scenario, when the user would like to switch from the proximity communication link 20 to the remote communication link 16, the remote control device 12 is kept within the range of the proximity communication link 20 until the signal indicative of the planned switch in communication links is sent over the proximity communication link 20. In the case where the user removes the remote control device 12 from within the range of the proximity communication link 20 prior to the remote control device 12 having sent the signal indicative of the planned communication link change, the locomotive control device 14 is unable to receive signals over the proximity communication link 20 and therefore may be unaware of the communication link change. The sections below describe two examples for handling the change in communication link in the above noted situation.

In one example of implementation, when the user removes the remote control device 12 from the range of the proximity communication link 20 prior to the remote control module transmitting the signal indicative of the planned communication link change, the locomotive control device 14, in the absence of command signals from the remote control device 12, will initiate a default emergency process, such as, for example, automatically causing the brakes to be applied. In order to remedy this situation, the user can place the remote control device 12 back in the range of the proximity communication link 20, such that the remote control device 12 can transmit a signal informing the locomotive control device 14 of the communication link switch. In response to that signal, the locomotive control device 14 switches to monitoring signals over the remote communication link 16.

In a second example of implementation, when the user removes the remote control device 12 from within the range of the proximity communication link 20 prior to the remote control module transmitting the signal indicative of the planned communication link change, the locomotive control device 14, upon detection that no signals are being received via the proximity communication link 20, automatically switches to monitoring signals over the remote communication link 16.

Third Scenario

Figure 8C:
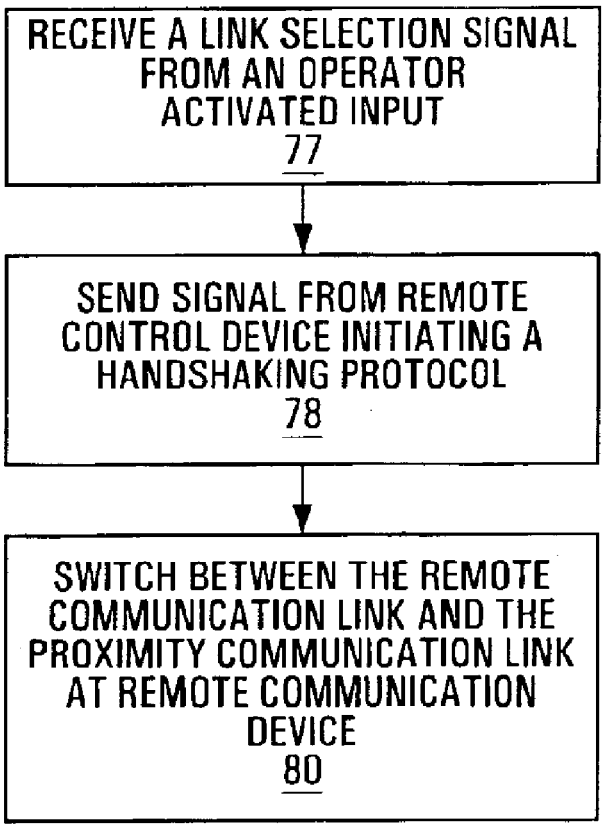

In a third scenario, which is described in the flow chart shown in FIG. 8*c*, the first step 77 involves receiving at the second input 39 a link selection signal from an operator activated input. In response to the selection signal, at step 78, the processing module 36 initiates a handshaking protocol with the locomotive control device 14. As will be described in more detail below, the handshaking protocol is an exchange of signals between the remote control device 12 and the locomotive control device 14, for establishing an agreement as to which communication link they will use. At step 80, once the handshaking protocol has been performed, both the remote control device 12 and the locomotive control device 14 are operative to switch to the selected communication link that was established by the handshaking protocol. It will be appreciated that any suitable handshaking protocol may be used here without detracting from the spirit of the invention.

The use of a handshaking protocol provides the advantage that the remote control device 12 receives signals from the locomotive control device 14 confirming that the locomotive control device 14 accepts the change in communication link.

In normal operation of the scenario described with respect to FIG. 8*c*, the handshaking protocol takes place over the communication link that the remote control device 12 was in the process of using when it received the selection signal. For example, in the case where the remote control device 12 and the locomotive control device 14 were communicating over the remote communication link 16 when the remote control device 12 received the link selection signal, the handshaking protocol is performed over the remote communication link 16. Once the handshaking protocol is complete, both the remote control device 12 and the locomotive control device 14 switch to using the proximity communication link 20. In other words, the remote control device 12 selects the proximity communication link 20 for transmitting signals, and the locomotive control device 14 starts monitoring signals received over the proximity communication link 20.

In order to switch from the proximity communication link 20 to the remote communication link 16, upon receipt of a selection signal at second input 39, the remote control device 12 initiates the handshaking protocol over the proximity communication link 20. Once the handshaking protocol is complete, the remote control device 12 selects the remote communication link 16 over which to transmit signals, and the locomotive control device 14 starts monitoring signals received over the remote communication link 16.

During the course of normal operation of this third scenario, when the user would like to switch from the proximity communication link 20 to the remote communication link 16, the remote control device 12 is kept within the range of the proximity communication link 20 until the handshaking protocol is completed. In the case where the user removes the remote control device 12 prior to the completion of the handshaking protocol, the locomotive control device 14 is unable to receive signals over the proximity communication link 20 and therefore is unaware of the communication link change. The sections below describe two examples for handling the change in communication link in the above noted situation.

In one example of implementation, when the user removes the remote control device 12 from the range of the proximity communication link 20 prior to the completion of the handshaking protocol, the locomotive control device 14, in the absence of command signals from the remote control device 12, will initiate a default emergency process, such as, for example, automatically causing the brakes the brakes to be applied. In order to remedy this situation, the user can place the remote control device 12 back in the range of the proximity communication link 20, such that the remote control device 12 and the locomotive control device 14 can complete the handshaking protocol. In response to the handshaking protocol, the locomotive control device 14 switches to receiving signals over the remote communication link 16.

In a second example of implementation, when the user removes the remote control device 12 from the range of the proximity communication link 20 prior to the completion of the handshaking protocol, the locomotive control device 14 detects that no signals are being received via the proximity communication link 20 and automatically switches to monitoring to signals received over the remote communication link 16.

Second Embodiment—Selection Signal Received Via a Proximity Detector Located on the Remote Control Device 12

In a second specific embodiment of the invention, the remote control device 12 is operative to receive a link selection signal via the proximity detector 69 located on the remote control device 12. As shown in FIG. 6, the proximity detector 69 is included as part of second input 39.

In a first example of implementation, the proximity detector 69 is a physical sensor that is able to detect when the remote control device 12 is in proximity to the locomotive control device 14. Many possible structures for detecting proximity may be used including the use of contact with a specific surface, engagement with a corresponding part, inductance, and an IR interface, to name just a few examples. As such, when the proximity detector 69 detects proximity of the locomotive control device 14, the second input 39 receives a selection signal indicative that the remote control device 12 is in proximity to the locomotive control device 14. However, when the proximity detector 69 detects that the remote control device 12 is no longer in proximity to the locomotive control device 14, the second input 39 ceases to receive the link selection signal.

In a specific example of implementation, the proximity detector 69 includes an electrical contact and is adapted to detect proximity to the locomotive control device 14 when it is in contact with a corresponding electrical contact contained within the docking port 59. Optionally, in addition to allowing for the detection of proximity, the electrical contact connection is operative to charge the power source of the remote control device 12.

Alternatively, in a second example of implementation, the proximity detector 69 includes a receiver that is able to detect when the remote control device 12 is in proximity to a locomotive 18, by receiving signals emitted from the locomotive control device 14. The signals emitted from the locomotive control device 14 are detectable by the proximity detector 69 when the remote control device 12 is in proximity to the locomotive control device 14. When the proximity detector 69 detects proximity of locomotive control device 14, the second input 39 receives link selection signals. Based at least in part on the link selection signals, the processing module 36 is operative to select the proximity communication link 20. However, when no signals are being received at second input 39, meaning that the remote control device 12 is no longer in proximity to the locomotive control device 14, the processing module 36 by default switches to the remote communication link 16.

When the selection signal is received by the second input 39, there are many scenarios by which the remote control device 12 and the locomotive control device 14 can establish communication over the selected one of the remote communication link 16 or the proximity communication link 20. Two possible scenarios will be described below with reference to the flow charts and diagrams shown in FIGS. 9*a*, 9*b* and 1*a*, 10*b*, 10*c*.

First Scenario

The first scenario will be described with reference to the flow chart shown in FIG. 9*a*, and the embodiments of the remote control device 12 and the locomotive control device 14 shown in FIG. 9*b*.

Figure 9A:
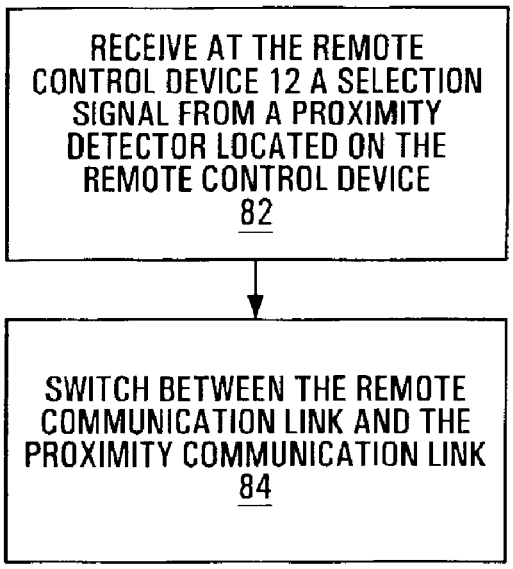
FIG. 9*a* shows a flow diagram of processes for selecting a communication link wherein the selection signal is received via a proximity detector located on the remote control device, in accordance with a first specific example of implementation of the present invention.
Figure 9B:
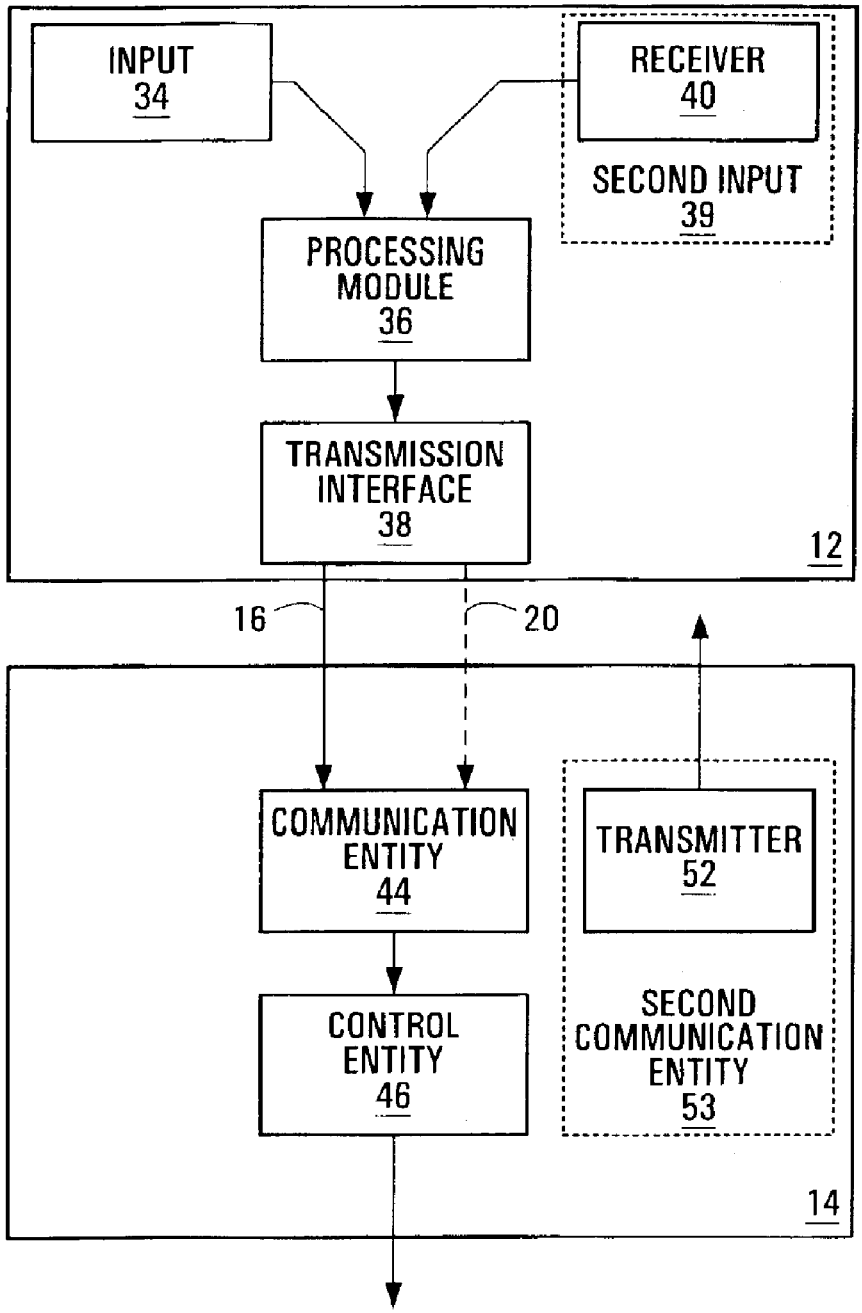
FIG. 9*b* shows a functional block diagram of a remote control device and a locomotive control device in communication with each other, in accordance with a specific example of implementation of the present invention.

As shown in the flow chart in FIG. 9*a*, the first step 82 involves receiving a link selection signal from the proximity detector 69 at the second input 39. In the embodiment shown in FIG. 9*b*, the locomotive control device 14 includes a transmitter 52 for transmitting a selection signal that can be detected by the proximity detector 69. The transmitter 52 is included within second communication entity 53, which can be a separate component as shown in FIG. 9*b*, or can interface with proximity communication interface 67, as shown in FIG. 6.

Referring back to the flow chart shown in 9*a*, at step 84, the processing module 36 selects one of the remote communication link 16 or the proximity communication link 20, on the basis of whether or not a selection signal is received at second input 39. The transmission interface 38 is then able to transmit command data to the locomotive control device 14 over the selected one of the communication links 16 or 20.

Preferably, in this first scenario, the locomotive control device 14 is adapted to monitor signals sent over both the remote communication link 16 and the proximity communication link 20. As such, the locomotive control device 14 is programmed such that when it receives signals over the proximity communication link 20, it disregards all signals received over the remote communication link 16. Alternatively, instead of having the locomotive control device 14 disregard signals received over the remote communication link 16 when it receives signals over the proximity communication link 20, the processing module 36 of the remote control device 12 embeds a signal within the transmitted command data, indicating to the locomotive control device 14 which communication link it should be listening to.

Second Scenario

The second scenario will be described with reference to the flow chart shown in FIG. 10*a*, and the embodiments of the remote control device 12 and the locomotive control device 14 shown in FIGS. 10*b* and 10*c*.

Figure 10A:
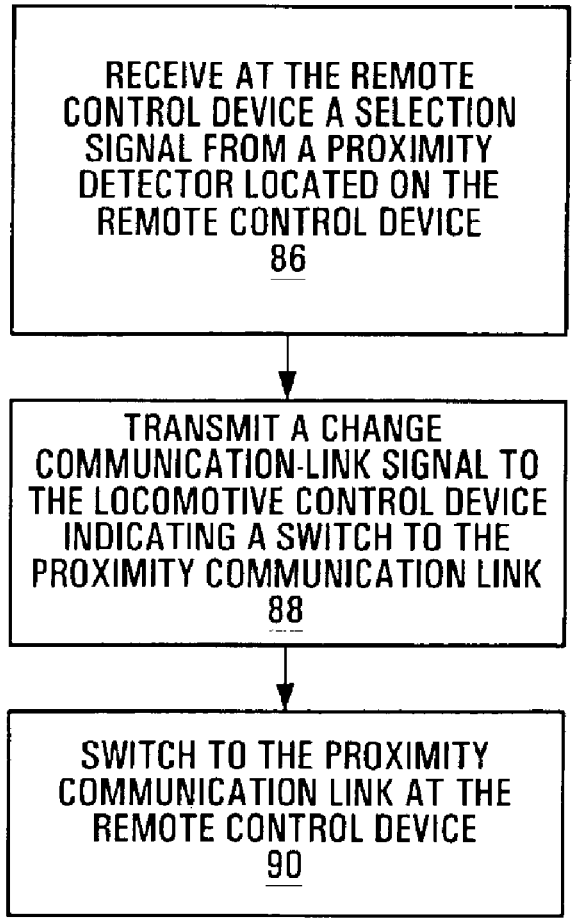
FIG. 10*a* shows a flow diagram of a process for selecting a communication link wherein the selection signal is received via a proximity detector located on the remote control device, in accordance with a second specific example of implementation of the present invention.

As shown in FIG. 10*a*, the first step 86 of this scenario involves receiving a link selection signal from the proximity detector 69 at the second input 39. The second step 88 involves transmitting, in response to the selection signal, a change-communication-link signal from the remote control device 12 to the locomotive control device 14. The change-communication-link signal can be a simple signal indicating to the locomotive control device 14 that the remote control device 12 is about to switch to the proximity communication link 20, or the change-in-communication-link signal may initialise a handshaking protocol between the remote control device 12 and the locomotive control device 14.

Figure 10B:
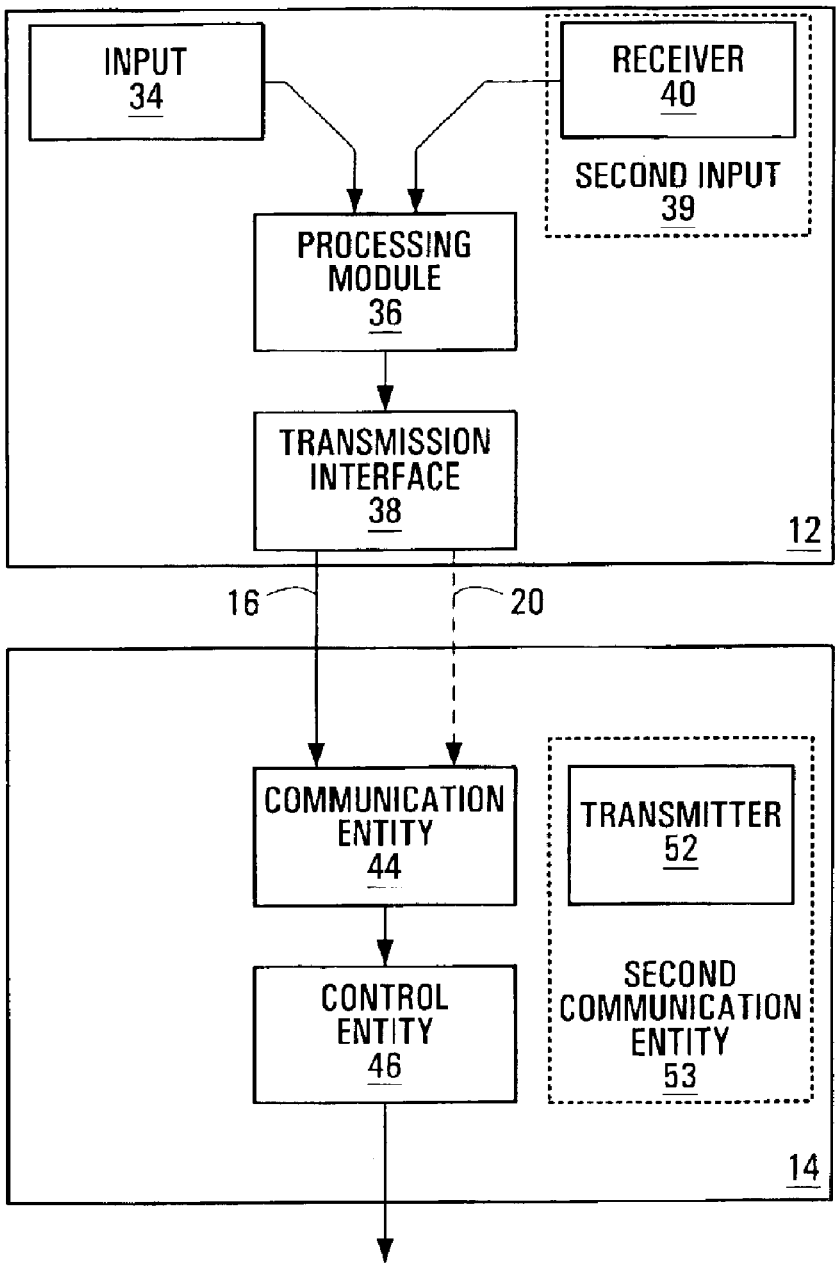
FIGS. 10*b*–*c* shows a functional block diagram of a remote control device and a locomotive control device in communication with each other, in accordance with a specific example of implementation of the present invention.

With reference to FIG. 10*b*, in the case where the proximity detector 69 at the second input 39 includes a receiver 40, and the second communication entity 53 includes a transmitter 52, the change-communication-link signal is transmitted from the remote control device 12 to the locomotive control device 14 over the remote communication link 16. In addition, any handshaking protocols that need to be performed would also take place over the remote communication link 16.

Figure 10C:
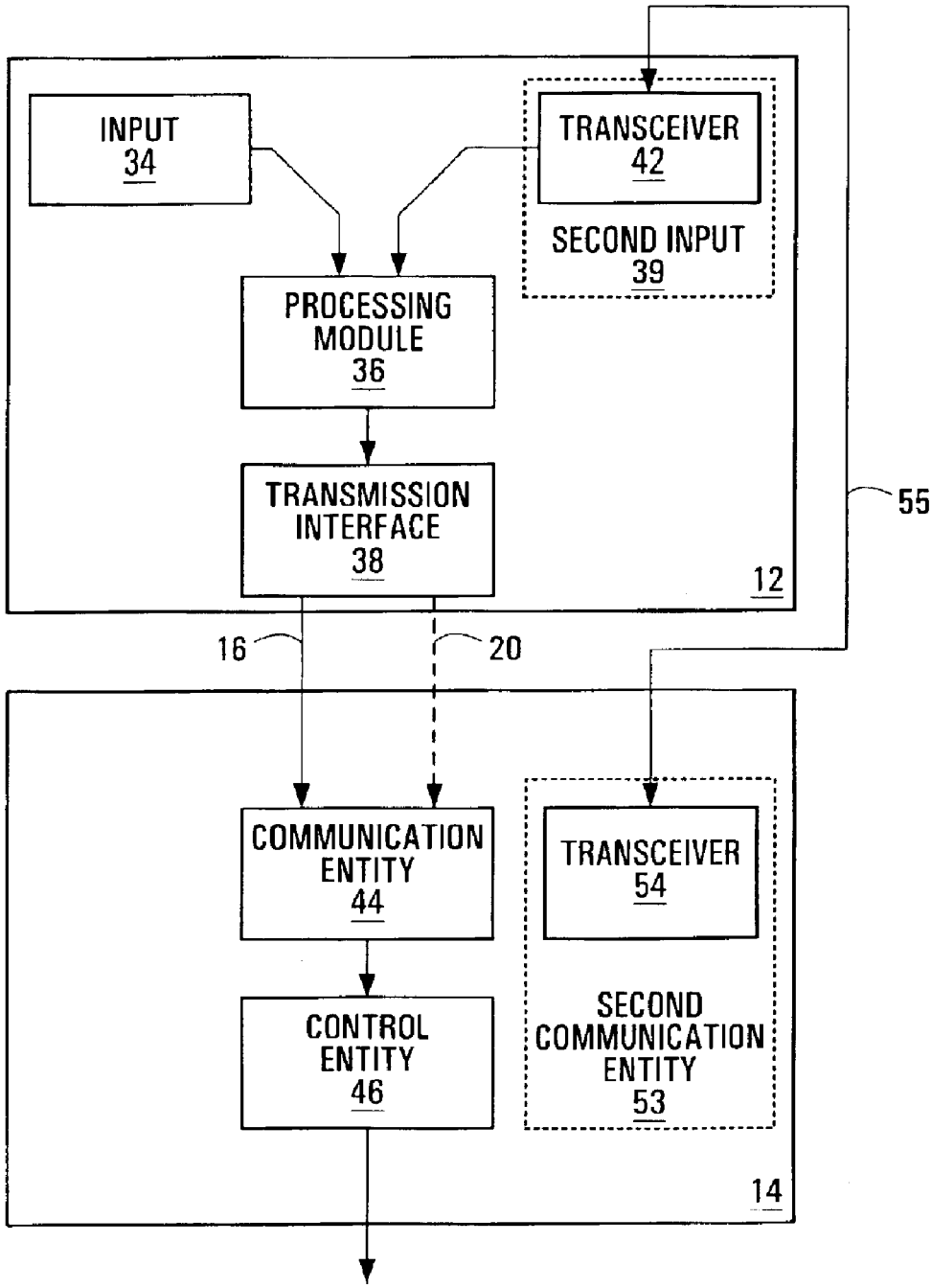

However, with reference to FIG. 10*c*, in the case where the proximity detector 69 at the second input 39 includes a transceiver 42, and the second communication entity 53 also includes a transceiver 54, then the change-communication-link signal can be transmitted from the remote control device 12 to the locomotive control device 14 through a communication link 55 between the transceiver 42 and transceiver 54. In addition, any handshaking protocols would also take place over the communication link 55. It should be understood that the communication link 55 could be the same communication link as the proximity communication link 20.

Referring back to the flow chart shown in FIG. 10*a*, at step 90, once the change-communication-link signal has been sent over one of the communication links described above, and any handshaking protocols have been completed, the remote control device 12 and the locomotive control device 14 start communicating over the proximity communication link 20. In other words, the transmission interface 38 is able to transmit command data to the locomotive control device 14 over the proximity communication link 20.

The above description relates to the process of switching from the remote communication link 16 to the proximity communication link 20. The process for switching from the proximity communication link 20 to the remote communication link 16 is different. Once the remote control device 12 is removed from within the range of the proximity communication link 20, the remote control device 12 is unable to send a signal to the locomotive control device 14 over the proximity communication link 20, or the communication link 55. As such, when the remote control device 12 is removed from within the range of the proximity communication link 20, the proximity detector 69 detects that the remote control device 12 is no longer in proximity to the locomotive control device 14, which results in the absence of a link selection signal at the second input 39, which thereby causes the processing module 36 to default to selecting the remote communication link 16. Furthermore, the locomotive control device 14, in the absence of any signals being received over the proximity communication link 20, automatically switches to being able to receive signals over the remote communication link 16.

Third Embodiment—Selection Signal Received Via a Proximity Detector Located on the Locomotive Control Device 12

In a third specific embodiment of the invention, the locomotive control device 14 includes a proximity detector 71. As shown in FIG. 6, the proximity detector 71 is included as part of second communication entity 53.

When the proximity detector 71 detects the proximity of the remote control device 12, the locomotive control device 14 transmits a selection signal to the remote control device 12, which is received at second input 39. Based on the selection signal, the processing module 36 can select the remote communication link 16 or the proximity communication link 20 for the transmission of the command signals.

In a first example of implementation, the proximity detector 69 is a physical sensor that is able to detect when the remote control device 12 is in proximity to the locomotive control device 14. Many possible structures for detecting proximity may be used including the use of contact with a specific surface, engagement with a corresponding part, inductance, and an IR interface, to name just a few examples. For example, in a specific example of implementation, the proximity detector 71 includes an electrical contact and is adapted to detect proximity to the remote control device 12 when it is in contact with a corresponding electrical contact contained on the remote control device 12.

Alternatively, in a second example of implementation, the proximity detector 71 is a transceiver 54 that is able to detect when the remote control device 12 is in proximity to the locomotive control device 14 by receiving signals emitted from the remote control device 12. The signals emitted from the remote control device 12 are detectable by the proximity detector 71 when the remote control device 12 is in proximity to the locomotive 18.

Once the proximity detector 71 of the locomotive control device 14 has detected the proximity of the remote control device 12, the locomotive control device 14 is operative to transmit a link selection signal to the remote control device 12, for causing the remote control device 12 to start transmitting over the proximity communication link 20. There are many scenarios in which the selection signal can be transmitted to the remote control device 12, and in which the remote control device 12 and the locomotive control device 14 can establish communication over the proximity communication link 20. One possible scenario will be described below with reference to the flow chart shown in FIG. 11*a* and the embodiment of the remote control device 12 and the locomotive control device 14 shown in FIG. 11*b*.

First Scenario

Figure 11A:
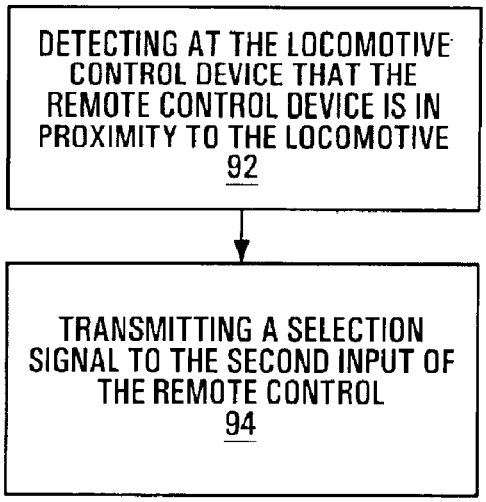
FIG. 11*a* shows a flow diagram of a process for selecting a communication link wherein the selection signal is received via a proximity detector located on the locomotive control device, in accordance with a specific example of implementation of the present invention.
Figure 11B:
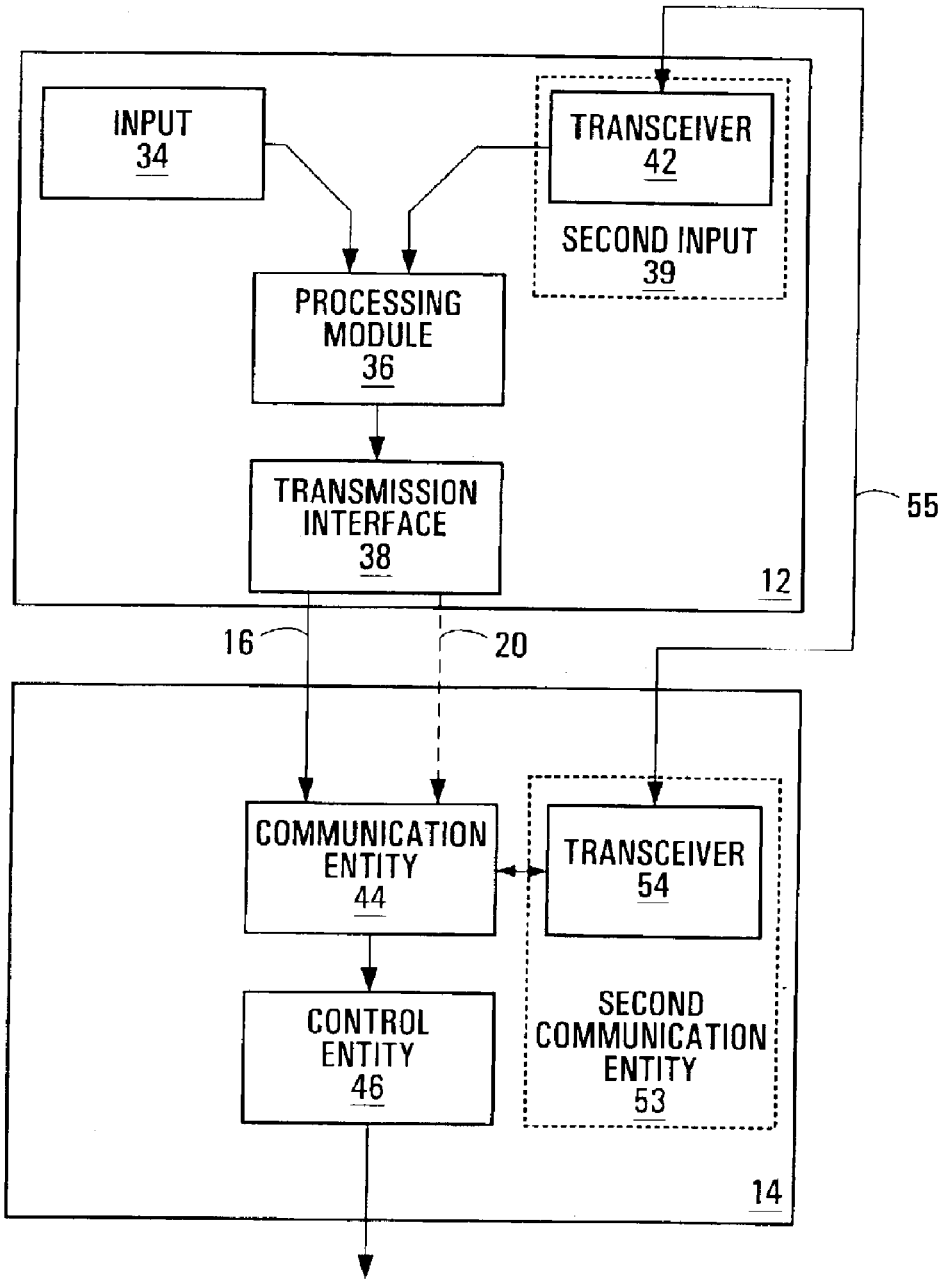
FIG. 11*b* shows a functional block diagram of a remote control device and a locomotive control device in communication with each other, in accordance with a specific example of implementation of the present invention.

As shown in the flow chart in FIG. 11*a*, the first step 92 involves detecting by the proximity detector 71 that the locomotive control device 14 is in proximity to the remote control device 12. In the embodiment shown in FIG. 11*b*, the second input 39 of the remote control device 12 includes a transceiver 42 for transmitting a signal that can be detected by the proximity detector 71 when the remote control device 12 is in proximity to the locomotive control device 14. It should be understood that the transceiver 42 is not a necessary component in the embodiment wherein the proximity detector 71 detects proximity of the remote control device 12 simply through contact or engagement with another component.

Referring back to the flow chart shown in FIG. 11*a*, the second step 94 involves the locomotive control device 14 transmitting a link selection signal to the second input 39 of the remote control device 12. The link selection signal may be a simple signal informing the remote control device 12 to switch to transmitting over the proximity communication link 20, or the link selection signal may initiate a handshaking protocol between the locomotive control device 14 and the remote control device 12.

The link selection signal can be transmitted from the locomotive control device 12 to the second input 39 of the remote control device 14 over the remote communication link 16, or alternatively, in the case where the proximity detector 71 includes a transceiver 54, the link selection signal can be transmitted to the second input 39 of the remote control device 12 over a communication link 55 between transceiver 42 and transceiver 54. In addition, any handshaking protocols could also take place over the remote communication link 16 or the communication link 55. Once the link selection signal has been sent, and any handshaking protocols have been completed, the remote control device 12 switches to transmitting signals over the proximity communication link 20.

The above scenario describes the process for switching from the remote communication link 16 to the proximity communication link 20. The process for switching from the proximity communication link 20 to the remote communication link 16 is different. When the proximity detector 71 of the locomotive control device 14 detects that it is no longer in proximity to the remote control device 12, it automatically switches to monitoring signals received over the remote communication link 16. In addition to switching back to the remote communication link 16, the locomotive control device 12 transmits a signal to the remote control device 12 over the remote communication link 16 indicating that the processing module 36 should switch back to transmitting the command signals over the remote communication link 16. Therefore, in this embodiment, the remote control device monitors signals received over both the remote communication link 16 and the proximity communication link 20.

Physical Implementation

Those skilled in the art should appreciate that in some embodiments of the invention, all or part of the functionality previously described herein with respect to the processing module 36, or the control entity 46 may be implemented as preprogrammed hardware or firmware elements (e.g., application specific integrated circuits (ASICs), electrically erasable programmable read-only memories (EEPROMs), etc.), or other related components.

In other embodiments of the invention, all or part of the functionality previously described herein with respect to either of the processing module 36 or the control entity 46 may be implemented as software consisting of a series of instructions for execution by a computing unit. The series of instructions could be stored on a medium which is fixed, tangible and readable directly by the computing unit, (e.g., removable diskette, CD-ROM, ROM, PROM, EPROM or fixed disk), or the instructions could be stored remotely but transmittable to the computing unit via a modem or other interface device (e.g., a communications adapter) connected to a network over a transmission medium. The transmission medium may be either a tangible medium (e.g., optical or analog communications lines) or a medium implemented using wireless techniques (e.g., microwave, infrared or other transmission schemes).

Figure 12:
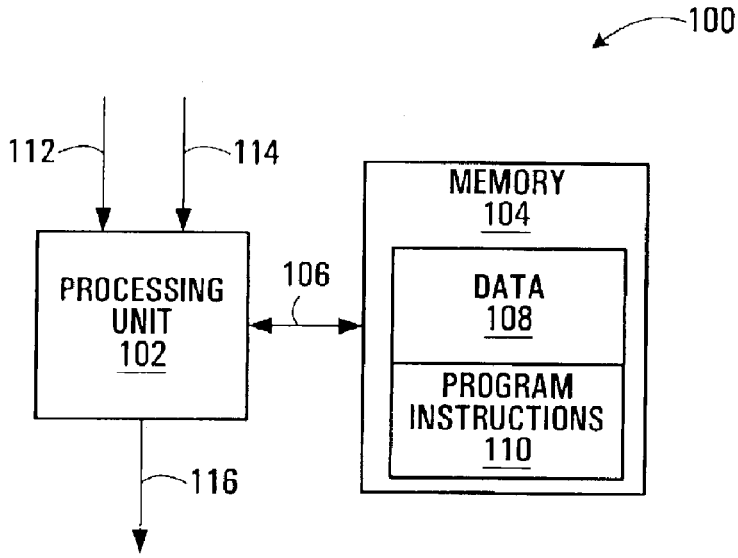
FIG. 12 shows a computing unit for implementing a processing unit for selecting between a remote communication link and a proximity communication link in accordance with a specific example of implementation of the present invention.

The processing module 36 for switching between a remote communication link 16 and a proximity communication link 20 may be configured as a computing unit 100 of the type depicted in FIG. 12, including a processing unit 102 and a memory 104 connected by a communication bus 106. The memory 104 includes data 108 and program instructions 110. The processing unit 102 is adapted to process the data 108 and the program instructions 110 in order to implement the functionality described in the specification and depicted in the drawings. The computing unit 100 may also comprise a number of interfaces 112, 114 and 116 for receiving or sending data elements to external devices. For example, interface 112 can receive an input command signal from an operator, and interface 114 can receive the selection signal from the second input 39, as described above. The processing unit 102 is operative for processing the command signals and processing the selection signal to select either the remote communication link 16 or the proximity communication link 20. Interface 116 is for releasing the data indicative of the selection between the remote communication link 16 or the proximity communication link 20 and the command data. The released data is transmitted to the transmission interface 38.

In a specific example of implementation, the memory 104 includes a program element contained within the program instructions 110, for execution by the computing unit 100. Once the processing unit 102 has received the selection signal, the program element is operative to process the selection signal so as to be able to select one of the remote communication link 16 or the proximity communication link 20.

Those skilled in the art should further appreciate that the program instructions 110 may be written in a number of programming languages for use with many computer architectures or operating systems. For example, some embodiments may be implemented in a procedural programming language (e.g., "C") or an object oriented programming language (e.g., "C++" or "JAVA").

Although the present invention has been described in considerable detail with reference to certain preferred embodiments thereof, variations and refinements are possible without departing from the spirit of the invention. Therefore, the scope of the invention should be limited only by the appended claims and their equivalents.

What is claimed is:

1. A portable remote control device adapted for transmitting command signals to a locomotive control device located onboard a locomotive, wherein said command signals are indicative of a command to be executed by the locomotive, said portable remote control device including a processing module for selecting one of a remote communicating link and a proximity communication link for transmitting said command signals, said portable remote control device being adapted for transmitting said command signals over the selected one of the remote communication link and the proximity communication link.

2. A portable remote control device as defined in claim 1, wherein said processing module selects one of the remote communication fink and the proximity communication link at least in part on the basis of a link selection signal, the link selection signal indicating proximity of the portable remote control device to the locomotive.

3. A portable remote control device as defined in claim 2, wherein the remote communication link is a radio frequency (RF) communication link.

4. A portable remote control device as defined in claim 3, wherein the proximity communication link is selected from the list consisting of an inductive communication link, an optical communication link, a short range radio frequency (RF) communication link and a wire-line communication link.

5. A portable remote control device as defined in claim 4, wherein the proximity communication link and the remote communication link are distinguished based on the range of their communication link.

6. A portable remote control device as defined in claim 5, wherein the range of the proximity communication link is limited to within the locomotive.

7. A portable remote control device as defined in claim 2, wherein the link selection signal is provided by an operator of the portable remote control device.

8. A portable remote control device as defined in claim 2, wherein the link selection signal is provided by the locomotive control device onboard the locomotive.

9. A portable remote control device for a locomotive remote control system, said device comprising:

a) a input for receiving an input command signal from a train operator;

b) a second input for receiving a signal indicating proximity of the portable remote control device to a locomotive;

c) a processing module in communication with said first input for receiving said input command signal and said second input for receiving said signal indicating proximity of the portable remote control device to a locomotive, said processing module being adapted for:

i. generating in response to the input command signal command data indicative of a command to be executed by a locomotive;

ii. selecting a transmission link between a remote communication link and a proximity communication link for the transmission of the command data indicative of a command to be executed by a locomotive at least in part on the basis of said signal indicating proximity of the portable remote control device to a locomotive;

d) a transmission interface operative for transmitting the data indicative of a command to be executed by the locomotive to a locomotive control device onboard the locomotive over the selected transmission link.

10. A portable remote control device as defined in claim 9, wherein the remote communication link is a radio frequency (RF) communication link.

11. A portable remote control device as defined in claim 10, wherein the proximity communication link is a short range radio frequency (RF) communication link.

12. A portable remote control device as defined in claim 10, wherein the proximity communication link is an infrared communication link.

13. A portable remote control device as defined in claim 10, wherein the proximity communication link is a wire-line communication link.

14. A portable remote control device as defined in claim 10, wherein the proximity communication link is established when said portable remote control device is docked at a docking port located within the locomotive.

15. A portable remote control device as defined in claim 10, wherein the selection signal is provided by the locomotive control device onboard the locomotive.

16. A portable remote control device as defined in claim 10, wherein said second input is a proximity detector.

17. A portable remote control device as defined in claim 9, wherein the selection signal is provided by an operator of the portable remote control device.

18. A portable remote control device as defined in claim 9, wherein said portable remote control unit includes a user interface having at least one of a keyboard, buttons, levers, toggles, a touch sensitive screen, a pointing device and a voice recognition unit.

19. A portable remote control device as defined in claim 17, wherein the selection signal is input by a user via said user interface.

20. A method for establishing a communication link between a portable remote control device and a locomotive control device of a locomotive remote control system, the locomotive control device being located onboard a locomotive, said method including:

a) receiving at the portable remote control device an input signal from a train operator, wherein the input signal is indicative of a command to be executed by the locomotive;

b) processing said input signal for generating command data indicative of a command to be executed by the locomotive;

c) receiving at the portable remote control device a selection signal, the selection signal indicating proximity of the portable remote control device to a locomotive;

d) selecting between a remote communication link and a proximity communication link at least in part on the basis of the received selection signal;

e) transmitting over the selected communication link to the locomotive control device, the data indicative of the command to be executed by the locomotive.

21. A locomotive control device adapted for being located onboard a locomotive, said locomotive control device comprising:

a) an input for receiving a selection signal for selecting either one of a remote communication link and a proximity communication link;

b) a communication entity responsive to said selection signal for:

I. selecting a communication link between a remote communication link and a proximity communication link on the basis of said selection signal;

II. receiving command data over the selected communication link from a remote control device, the command data being indicative of commands to be executed by the locomotive;

III. Issuing a local control signals to a locomotive control interface for causing the locomotive to execute commands conveyed by the command data.

22. A remote control system for a locomotive having a control interface, the remote control system comprising:

a) a remote control device having:

i. an input for receiving an input signal from a train operator;

ii. a processing module in communication with said input for receiving said input signal, said processing module being adapted for generating in response to the input signal command data indicative of a command to be executed by a locomotive;

III. a selector module adapted for:

(a) receiving a selection signal;

(b) selecting a transmission link between a remote communication link and a proximity communication link for the transmission of the command data indicative of a command to be executed by a locomotive at least in part on the basis of said selection signal;

iv. a transmission interface operative for transmitting the data indicative of a command to be executed by the locomotive to a locomotive control device over the selected transmission link;

b) a locomotive control device adapted for being located onboard the locomotive, said locomotive control device having:

a communication entity for receiving over the selected transmission link the data indicative of a command to be executed by the locomotive;

a control entity being responsive to the data indicative of a command to be executed by the locomotive for issuing local control signals to the control interface for causing the locomotive to execute the commands.

* * * * *